US010361513B2

(12) United States Patent
Nishi

(10) Patent No.: US 10,361,513 B2
(45) Date of Patent: Jul. 23, 2019

(54) CONNECTOR AND CONNECTOR ASSEMBLY

(71) Applicant: Molex, LLC, Lisle, IL (US)

(72) Inventor: Norihiro Nishi, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/943,152

(22) Filed: Apr. 2, 2018

(65) Prior Publication Data

US 2018/0294603 A1 Oct. 11, 2018

(30) Foreign Application Priority Data

Apr. 7, 2017 (JP) ..... 2017-076384

(51) Int. Cl.

| | |
|---|---|
| ***H01R 13/62*** | (2006.01) |
| ***H01R 13/639*** | (2006.01) |
| ***H01R 13/502*** | (2006.01) |
| ***H01R 13/631*** | (2006.01) |
| ***H01R 12/71*** | (2011.01) |

(52) U.S. Cl.

CPC ..... *H01R 13/639* (2013.01); *H01R 12/716* (2013.01); *H01R 13/502* (2013.01); *H01R 13/631* (2013.01)

(58) Field of Classification Search

CPC .. H01R 13/631; H01R 13/639; H01R 13/502; H01R 12/716

USPC ..... 439/299

See application file for complete search history.

(56) References Cited

U.S. PATENT DOCUMENTS 4,370,013 A * 1/1983 Niitsu ..... H01R 13/6272 439/352
5,993,238 A * 11/1999 Kudo ..... H01R 13/6272 439/352
6,213,810 B1 * 4/2001 Okano ..... H01R 12/592 439/495
6,315,603 B1 * 11/2001 Miura ..... H01R 12/774 439/260
6,386,898 B1 * 5/2002 Taguchi ..... H01R 13/635 439/352
6,430,053 B1 * 8/2002 Peterson ..... H01R 13/6335 361/728

(Continued)

FOREIGN PATENT DOCUMENTS

CN 2305794 Y 1/1999
CN 201018048 Y 2/2008

(Continued)

OTHER PUBLICATIONS

Notice of Allowance received for Korean Application No. 10-2018-0038970, dated Apr. 24, 2019, 2 pages (1 page of English translation and 1 page of Official copy).

*Primary Examiner* — Abdullah A Riyami
*Assistant Examiner* — Vladimir Imas
(74) *Attorney, Agent, or Firm* — Molex, LLC

(57) ABSTRACT

A through hole is formed in an end wall part of a first housing, and a slider is arranged in this through hole. The slider can be slid in the left-right direction between a locked position at which the slider is engaged with the second connector and an unlocked position at which the slider is separated from the second connector. The slider is a plate-like member arranged such that the thickness direction thereof is oriented in the height direction of the first housing.

11 Claims, 9 Drawing Sheets

(56) References Cited

U.S. PATENT DOCUMENTS 6,434,015 B1 * 8/2002 Hwang ..... H01R 13/635 361/728
6,645,005 B2 * 11/2003 Wu ..... H01R 12/707 439/563
6,692,289 B2 * 2/2004 Nemoto ..... H01R 13/62977 439/160
6,805,574 B2 * 10/2004 Huang ..... H01R 43/26 361/728
6,916,196 B2 * 7/2005 Long ..... H01R 13/627 439/352
7,168,986 B1 * 1/2007 Peng ..... H01R 12/716 439/607.04
7,381,077 B2 * 6/2008 Chen ..... G02B 6/4201 439/350
7,448,899 B2 * 11/2008 Chen ..... G11B 5/4846 439/372
7,833,042 B2 * 11/2010 Nishio ..... G02B 6/4201 439/331
7,845,958 B2 * 12/2010 Hoshino ..... H01R 13/6275 439/660
8,083,527 B2 * 12/2011 Takeuchi ..... H01R 13/26 439/65
8,162,694 B2 * 4/2012 Hisada ..... H01R 27/00 439/607.23
8,231,393 B2 * 7/2012 Liang ..... H01R 13/639 439/133
8,292,635 B2 * 10/2012 Little ..... H01R 12/7029 439/570
8,961,215 B2 * 2/2015 Hasegawa ..... H01R 9/091 439/346
9,172,172 B2 * 10/2015 Shindo ..... H01R 13/46
9,178,309 B2 * 11/2015 Tanaka ..... H01R 13/6271
9,190,770 B2 * 11/2015 Shindo ..... H01R 13/62
9,231,322 B2 1/2016 Ozeki
9,425,526 B2 * 8/2016 Uratani ..... H01R 13/6473
9,484,668 B2 * 11/2016 Kamei ..... H01R 13/502
9,634,410 B2 * 4/2017 Takane ..... H01R 12/716

FOREIGN PATENT DOCUMENTS

| | | | |
|---|---|---|---|
| CN | 201060978 | Y | 5/2008 |
| CN | 201215839 | Y | 4/2009 |
| CN | 101677154 | A | 3/2010 |
| JP | H04-368783 | A | 12/1992 |
| JP | 2013-118141 | A | 6/2013 |
| JP | 2014-212039 | A | 11/2014 |
| JP | 2015-060764 | A | 3/2015 |
| JP | 2015-170579 | A | 9/2015 |
| KR | 10-2014-0020189 | A | 2/2014 |
| KR | 10-2014-0086821 | A | 7/2014 |

* cited by examiner

CONNECTOR AND CONNECTOR ASSEMBLY

RELATED APPLICATIONS

This application claims priority to Japanese Application No. 2017-076384, filed Apr. 7, 2017, which is incorporated herein by reference in its entirety.

TECHNICAL FIELD

The present disclosure relates to a connector and a connector assembly.

BACKGROUND ART

Conventionally, a connector is used to connect two circuit boards facing each other (for example, see the following patent documents 1 to 4). A connector attached to one circuit board and another connector attached to the other circuit board are fitted to each other, thereby, connecting the two circuit boards. The height of this kind of connector is being reduced in association with the advancement of miniaturized, slimmer designs of electronic devices.

Patent Document 1: Japanese Unexamined Patent Application Publication No. H4-368783

Patent Document 2: Japanese Unexamined Patent Application Publication No. 2014-212039

Patent Document 3: Japanese Unexamined Patent Application Publication No. 2015-60764

Patent Document 4: Japanese Unexamined Patent Application Publication No. 2015-170579

SUMMARY

The contact area of the terminals of two connectors is becoming smaller in association with the reduction of the height of the connectors. As a result, the contact stability of the terminals of two connectors is becoming a more substantial problem.

One object of the present disclosure is to provide a connector and a connector assembly which can ensure the contact stability of the terminals even if the contact area of terminals of the connectors is reduced in association with a reduction of the height of the connector.

(1) An example of a connector assembly proposed by the present disclosure includes: a first connector having a first housing and a plurality of first terminals which are attached to the first housing and are aligned in a first direction; and a second connector having a second housing and a plurality of second terminals aligned in the first direction. The first housing includes: a peripheral wall part having at an inner side a recessed portion at which the second connector is arranged, wherein the peripheral wall part has: two wall parts extending in the first direction and opposing each other in a second direction orthogonal with respect to the first direction; and end wall parts positioned at the ends of the two wall parts, and extending in the second direction. A through hole penetrating each of the end wall parts in the first direction is formed in each of the end wall parts, with the first connector having a slider arranged in the through hole. The slider can be slid in the first direction between a locked position at which the slider is engaged with the second connector and an unlocked position at which the slider is separated from the second connector when the second connector is arranged inside the peripheral wall part. The slider is a plate-like member arranged such that the thickness direction thereof is oriented to a third direction which is the height direction of the first housing.

(2) The connector assembly according to (1) may further have a retaining member inserted in the third direction into the end wall part and the slider.

(3) In the connector assembly according to (2), a hole into which the retaining member is inserted may be formed between the end wall part and the slider.

(4) In the connector assembly according to (2) or (3), when the slider is positioned in the locked position, the retaining member may contact the slider to regulate movement of the slider toward the center of the first connector in the first direction, and a clearance in the first direction may be provided between the end of the slider and the second connector.

(5) In the connector assembly according to any of (2) to (4), the slider may have a portion that generates resistance against the movement of the slider in contact with the retaining member when the slider moves between the locked position and the unlocked position.

(6) In the connector assembly according to (5), a hole into which the retaining member is inserted may be formed in the slider, with the portion that generates resistance against the movement of the slider capable of being formed at the inner edge of the hole.

(7) In the connector assembly according to any of (1) to (6), the second connector may have an engagement member attached to the second housing and formed by metal, and the slider may be engaged with the engagement member to regulate movement of the second connector in the third direction when the slider is positioned in the locked position.

(8) In the connector assembly according to the (7), a hole into which the end of the slider is fitted when the slider is positioned in the locked position may be formed in the engagement member.

(9) In the connector assembly according to any of (1) to (8), the slider may have a portion that protrudes from the through hole to the outside in the first direction, and an engagement part capable of hooking a tool thereon may be formed on the portion of the slider.

(10) In the connector assembly according to any of (1) to (9), the slider may have a portion that protrudes from the through hole to the outside in the first direction, and the portion of the slider may be folded toward the bottom face of the first connector.

(11) In the connector assembly according to any of (1) to (10), the wall part of the first housing may have an area at which the plurality of first terminals are attached, and the height of the wall part of the first housing in the area may be lower than the height of the end wall part.

(12) An example of a connector proposed by the present disclosure has: a housing, along with a plurality of terminals attached to the housing and aligned in the first direction. The housing has a peripheral wall part having at an inner side a recessed portion at which another connector is arranged. The peripheral wall part has: two wall parts extending in the first direction and opposing each other in a second direction orthogonal with respect to the first direction; and end wall parts positioned at the ends of the two wall parts and extending in the second direction. A through hole penetrating each of the end wall parts in the first direction is formed in each of the end wall parts, with a slider arranged in the through hole. The slider can be slid in the first direction between a locked position at which the slider is engaged with the other connector and an unlocked position at which the slider is separated from the other connector when the other connector is arranged inside the peripheral wall part.

The slider is a plate-like member arranged such that the thickness direction thereof is oriented to a third direction which is the height direction of the housing.

DETAILED DESCRIPTION OF THE PREFERRED EMBODIMENTS

Hereinafter, embodiments of a connector and a connector assembly proposed by the present disclosure will be described. According to the present specification, as an example, a connector assembly and a connector connecting two circuit boards facing each other will be described (the term "circuit board" includes Flexible Printed Circuits (FPC) and Flexible Flat Cables (FFC)). According to the present specification, as an example of the connector assembly, a connector assembly 1 will be described. The connector assembly 1 has a first connector 10 and a second connector 70 (refer to FIG. 1).

Figure 1:
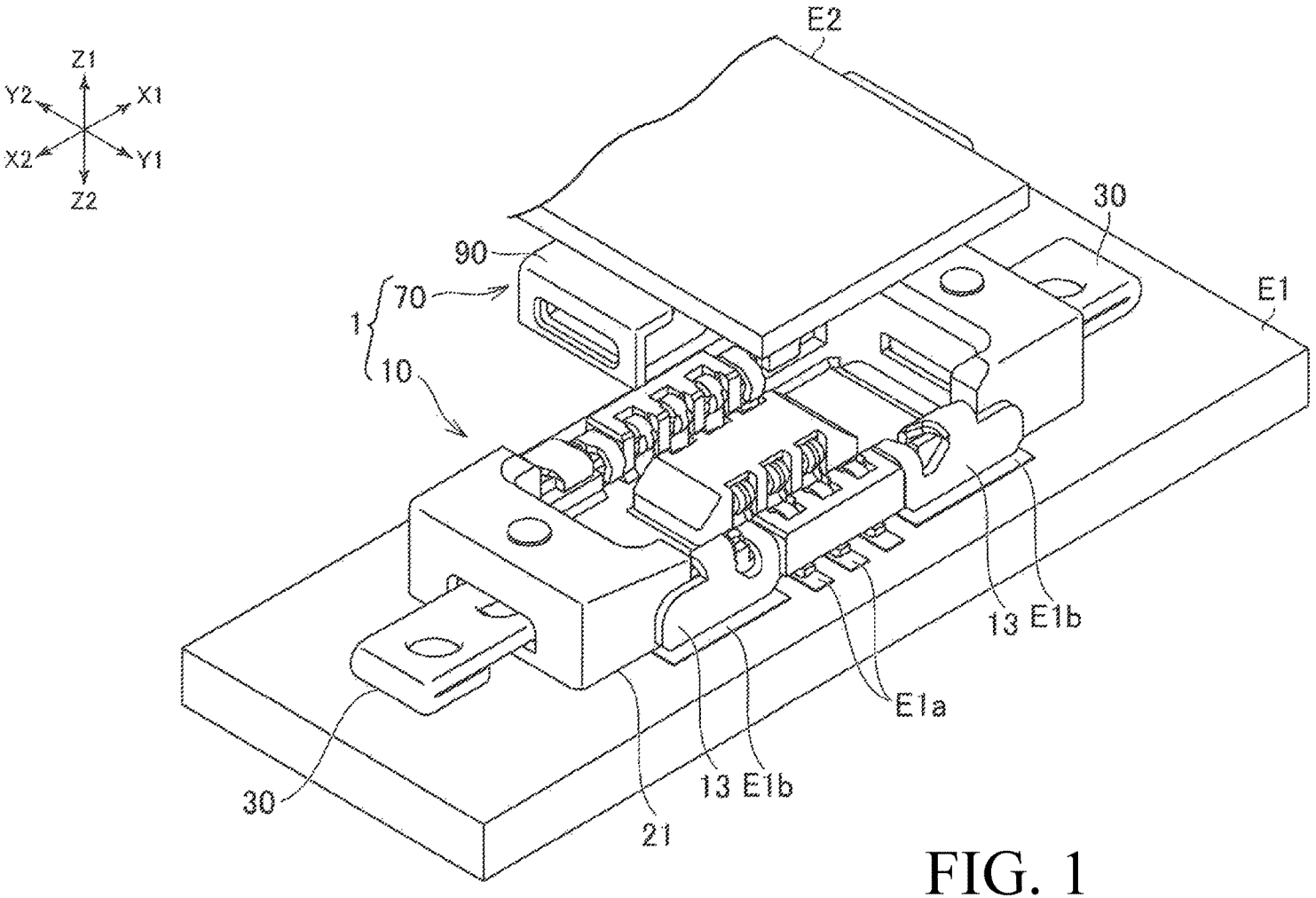
FIG. 1 is a perspective view illustrating an example of a connector assembly proposed by the present disclosure.

According to the following description, the Z1 direction illustrated in FIG. 1 is referred to as the upward direction, while the Z2 direction is referred to as the downward direction. Moreover, the X1 direction and the X2 direction are respectively referred to as the right direction and the left direction, while the Y1 direction and the Y2 direction are respectively referred to as the front side and the back side. "Upward direction," "downward," "right direction," "left direction," "front side," and "back side" indicate relative positional relations of regions of the connector, but do not specify postures of the connector when used.

Figure 2:
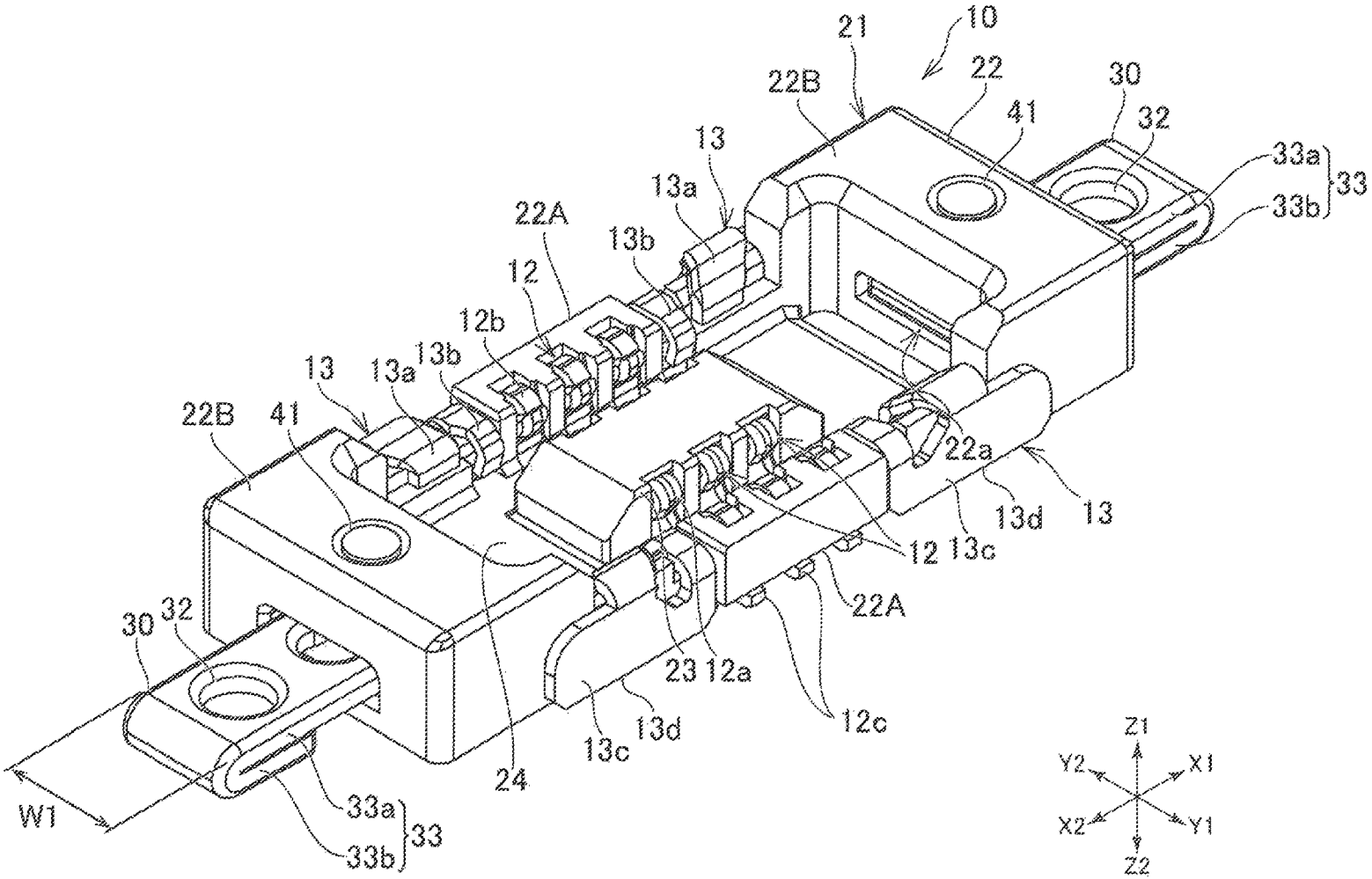
FIG. 2 is a perspective view of a first connector included in the connector assembly.

As illustrated in FIG. 2, a first connector 10 has: a first housing 21. The first housing 21 has two wall parts 22A extending horizontally and facing each other in the front and back direction, and two end wall parts 22B extending in the front and back direction and facing each other horizontally. Respective end wall parts 22B are positioned at the ends of the two wall parts 22A, and are connected to these two wall parts 22A. The wall part 22A and end wall part 22B form a peripheral wall part 22 having a recessed portion therein. The peripheral wall part 22 makes, for example, a rectangle as seen in the planar view of the first connector 10. A housing 21 may have a bottom face 24 inside the peripheral wall part 22. Further, the housing 21 may have a center wall part 23 formed on the bottom face 24. The center wall part 23 is formed inside the peripheral wall part 22 and extends in the left-right direction. The first housing 21 is formed, for example, from a resin.

As illustrated in FIG. 2, the first connector 10 has a plurality of terminals attached to the first housing 21 (hereinafter, a terminal 12 is referred to as a "first terminal"). According to the example of the first connector 10, the plurality of first terminals 12 is attached to the wall part 22A and aligned in the left-right direction. As illustrated in FIG. 2, the first terminals 12 may be aligned in two rows. In other words, the first connector 10 may have a plurality of terminals 12 arranged between the center wall part 23 and one wall part 22A, and a plurality of terminals 12 arranged between the center wall part 23 and another wall part 22A. Unlike the example of the first connector 10, the first housing 21 may be designed not having a center wall part 23. In this case, respective first terminals 12 may be bridged over two wall parts 22A facing each other. In another further example, the first connector may have a plurality of first terminals 12 aligned in three or four rows. In this case, the first connector 10 may have a plurality of center wall parts 23 aligned in the front and back directions.

In the example of the first connector 10, the first terminal 12 is formed into, for example, a substantial U shape opened upward. As illustrated in FIG. 2, grooves may be formed in the side face of the center wall part 23 and the inner face of the wall part 22A. The first terminal 12 may be arranged in these grooves. The first terminal 12 may have an inside contact part 12*a* arranged in the groove of the center wall part 23, as well as an outside contact part 12*b* arranged in the groove of the wall part 22A. In this case, because the second connector 70 has two contact points (in other words, the inside contact part 12*a* and the outside contact part 12*b*), it is possible to improve the connection reliability of the first connector 10 and second connector 70. Moreover, the first terminal 12 may have a connection part 12*c* located below the wall part 22A. When using the first connector 10, the first connector 10 is arranged on a circuit board E1 (refer to FIG. 1). The connection parts 12*c* are respectively attached to a plurality of conducting parts E1*a* (refer to FIG. 1) formed on the circuit board E1. The shape of the first terminal 12 and the attaching structure to attach the first terminal 12 to the first housing 21 may be appropriately changed. If the first connector 10 does not have a center wall part 23, the first terminal 12 may not have an inside contact part 12*a*.

As illustrated in FIG. 2, the first connector 10 may have a retainer 13 attached to the wall part 22A of the first housing 21. In the example of the first connector 10, the retainer 13 is arranged on the right and left sides of the plurality of first terminals 21 aligned in the left-right direction. The retainer 13 may have, for example, an outer wall part 13*c* positioned along the outer face of the first housing 21. The retainer 13 may have a guide part 13*a* extending from the upper edge of the outer wall part 13*c* and downward to the inside of the peripheral wall part 22 of the first housing 21. The guide part 13*a* guides the second connector 70 to the inside of the peripheral wall part 22 during the fitting process of the first connector 10 and second connector 70. The retainer 13 may have a contact part 13*b* located inside the peripheral wall part 22. The contact part 13*b* may be in contact with a terminal 73 (refer to FIG. 3) included in the second connector 70. The lower edge 13*d* of the outer wall part 13*c* of the retainer 13 may be located below the lower face of the first housing 21. In this case, the lower edge 13*d* of the outer wall part 13*c* may be attached to a conducting part E1*b* (refer to FIG. 1) formed on the circuit board E1, for example, via soldering. The first connector 10 may be designed not having a retainer 13.

Figure 3:
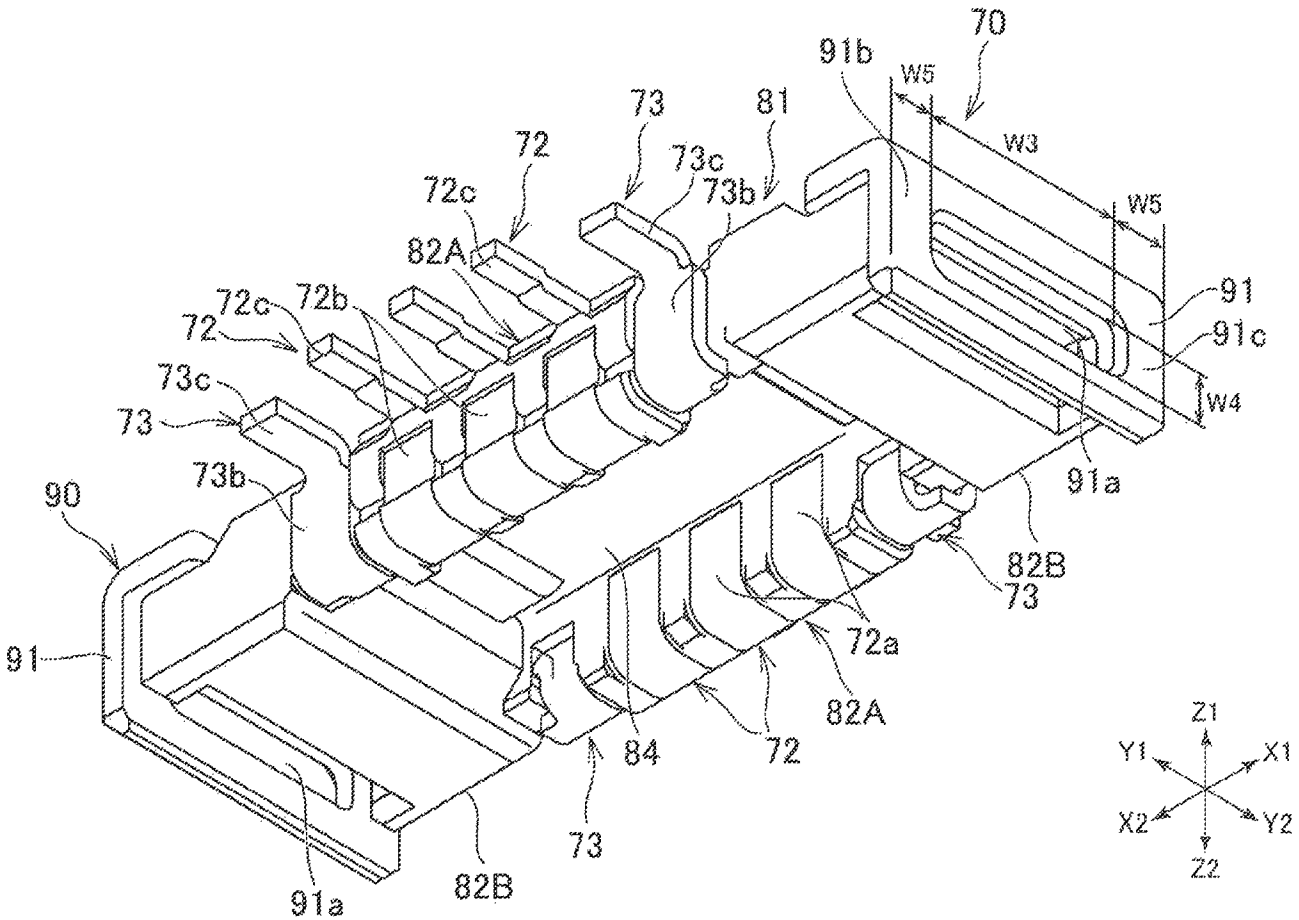
FIG. 3 is a perspective view of a second connector included in the connector assembly.

As illustrated in FIG. 3, the second connector 70 has a second housing 81. In the example of the second connector 70, the second housing 81 has: two wall parts 82A extending in the left-right direction and facing each other in the front and back direction, and two end wall parts 82B extending in the front and back direction and facing each other in the left-right direction. Respective end wall parts 82B connect the ends of the two wall parts 82A. The second housing 81 is formed, for example, in a rectangle as seen in the planar view. Recessed portions are formed inside the wall part 82A and end wall part 82B. The second housing 81 may further have a bottom face 84 formed inside the wall parts 82A and 82B. The second housing 81 is formed by a resin as with the first housing 21. The shape of the second housing 81 is not limited to the example of FIG. 3, but may be appropriately changed in accordance with the shape of the first connector 10.

As illustrated in FIG. 3, the second connector 70 has a plurality of terminals 72 aligned in the left-right direction (hereinafter, the terminal 72 is referred to as the "second terminal"). The second terminals 72 may be attached to the wall part 82A. In greater detail, the plurality of second terminals 72 may be attached to each of the two wall parts 82A. The second terminal 72 is formed into, for example, a substantial U shape and may be attached to the outer face of the wall part 82A and the inner face of the wall part 82A. In other words, the second terminal 72 may have an outside contact part 72*b* arranged on the outer face of the wall part 82A, and an inside contact part 72*a* arranged on the inner face of the wall part 82A. Moreover, the second terminal 72 may have a connection part 72*c* extending from the upper end of the outside contact part 72*b*. When using the second connector 70, the second connector 70 is arranged on a circuit board E2 (refer to FIG. 1). The connection part 72*c* of the second terminal 72 may be respectively attached to a plurality of conducting parts formed on the circuit board E2.

As illustrated in FIG. 3, the second connector 70 may have the terminals 73 aligned in the left-right direction along with the second terminals 72. The terminal 73 disposed at a position corresponding to the contact part 13*b* of the retainer 13 is in contact with the contact part 13*b* of the retainer 13 when the connectors 10, 70 are fitted to each other. The terminal 73 may also have an outside contact part 73*b* (refer to FIG. 3) arranged on the outer face of the wall part 82A as with the second terminal 72. When the connectors 10, 70 are fitted to each other, the contact parts 13*b* of the retainer 13 are in contact with the outside contact parts 73*b* of the terminals 73. The contact part 13*b* may be formed so as to be capable of elastically deforming such that contact pressure is generated between the contact part 13*b* and the terminal 73. The terminal 73 may have the connection part 73*c* extending from the upper end of the outside contact part 73*b*. When using the second connector 70, the connection part 73*c* of the terminal 73 may be attached to a plurality of conducting parts formed on the circuit board E2. In the example of the second connector 70, two terminals 73 are disposed at respective wall parts 82A, with the plurality of second terminals 72 arranged therebetween.

The second connector 70 and the first connector 10 are vertically fitted together. In the example of the present specification, the second connector 70 is arranged above the first connector 10. When the connectors 10, 70 are fitted together the second connector 70 is arranged inside the peripheral wall part 22 of the first housing 21. In the example of connectors 10, 70, the center wall part 23 of the first connector 10 is fitted in the recessed portion formed inside the two wall parts 82A and the two end wall parts 82B of the second connector 70. In this case, the wall part 82A of the second connector 70 is arranged between the center wall part 23 and the wall part 22A of the first connector 10.

As described above, the first terminal 12 of the first connector 10 is formed into a substantial U shape opened upward. When the connectors 10, 70 are fitted together, the second terminal 72 is arranged inside the first terminal 12 and sandwiched in the front and back directions by the first terminals 12. The outside contact part 72*b* of the second terminal 72 is in contact with the outside contact part 12*b* of the first terminal 12, while the inside contact part 72*a* of the second terminal 72 is in contact with the inside contact part 12*a* of the first terminal 12. The inside contact part 12*a* and the outside contact part 12*b* of the first terminal 12 may be capable of elastically deforming so as to sandwich the second terminal 72 therebetween.

The arrangement of the second terminal 72 and the shape of the second housing 81 are not limited to the example of the second connector 70, but may be appropriately changed in accordance with the structure of the first connector 10. For example, if the center wall part 23 is not formed on the first connector 10, the second housing 81 may not have two opposing wall parts 82A. In this case, the number of rows of the plurality of second terminals 72 may be one.

Figure 5:
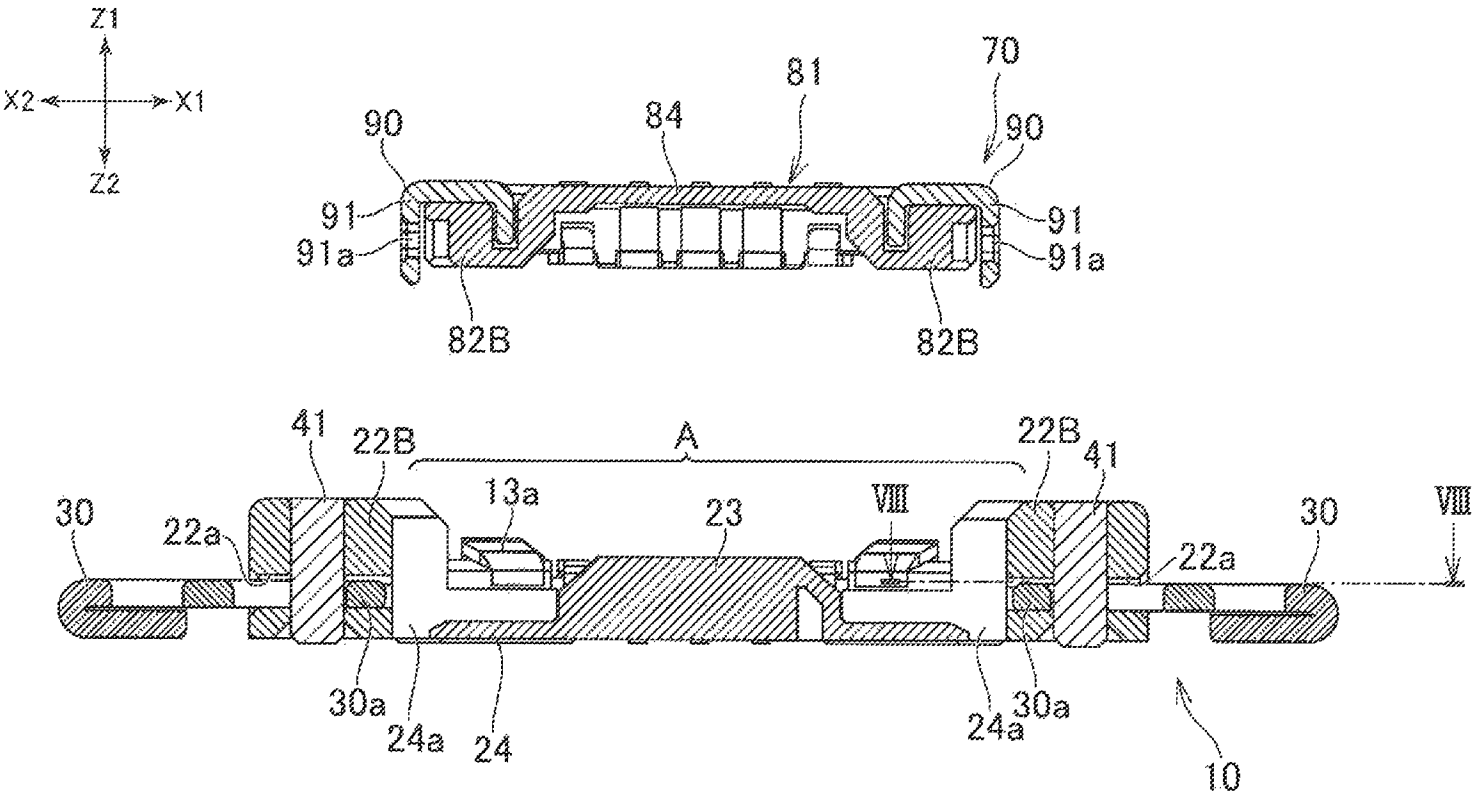
FIG. 5 is a cross-sectional view of a connector assembly taken along line V-V of FIG. 4. This drawing illustrates the first connector and second connector separated from each other.
Figure 6:
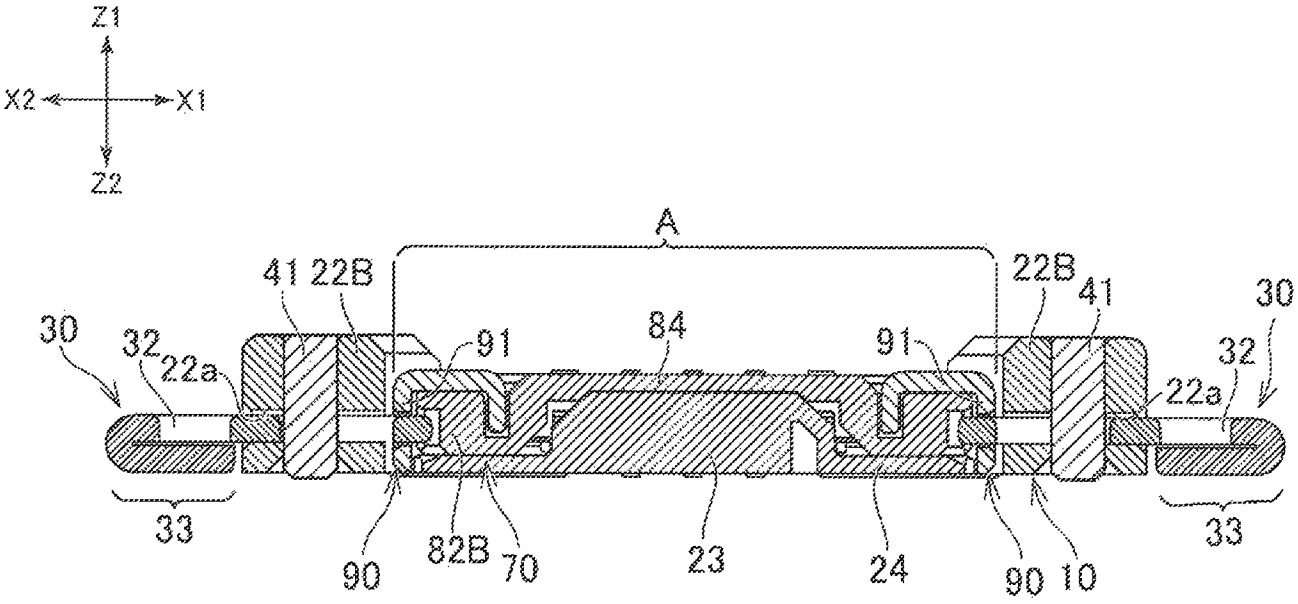
FIG. 6 is a cross-sectional view of the connector assembly taken along line V-V of FIG. 4. This drawing illustrates the first connector and second connector fitted to each other.
Figure 7:
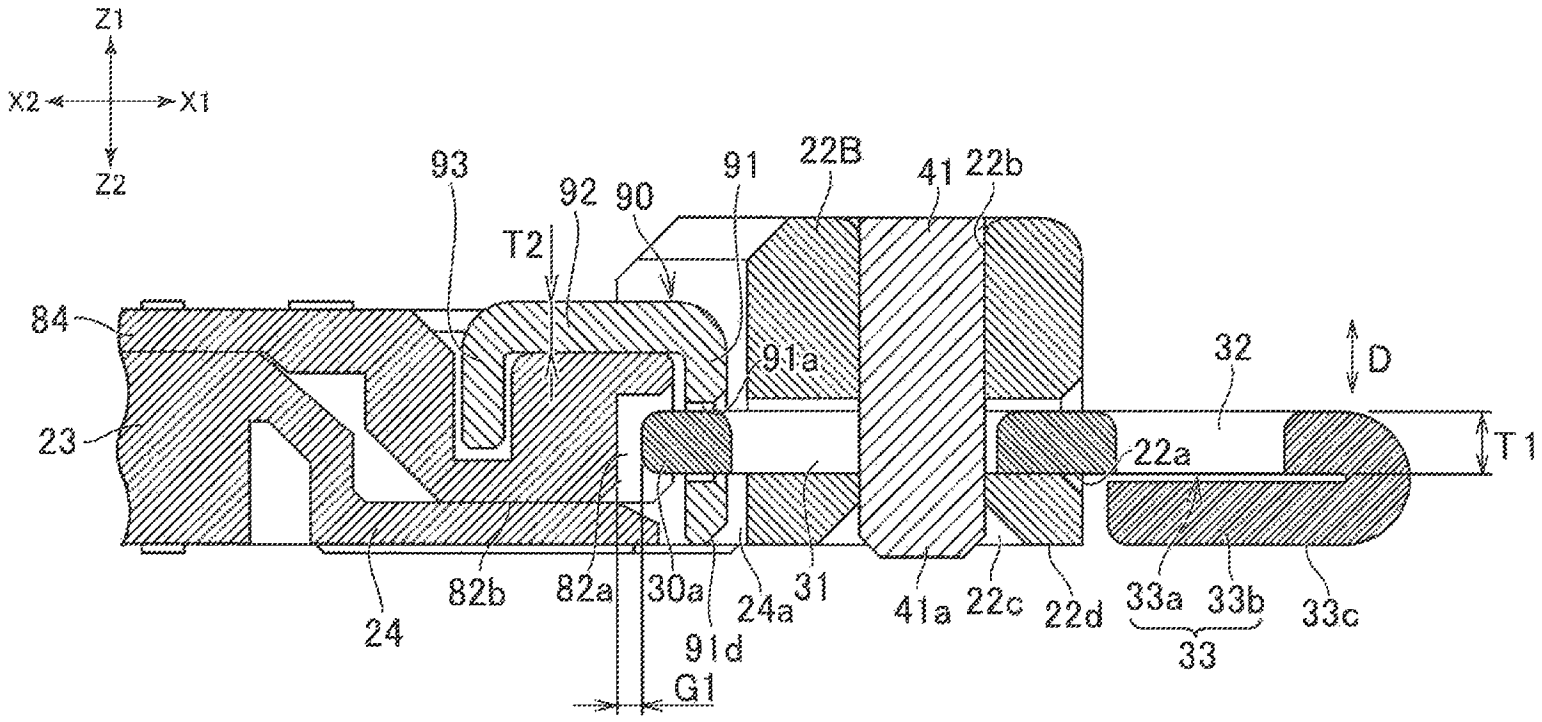
FIG. 7 is an enlarged view of FIG. 6.

As illustrated in FIG. 5 and FIG. 7, a through hole 22*a* horizontally penetrating the end wall part 22B may be formed in the end wall part 22B of the first housing 21. The first connector 10 may have a slider 30 arranged in this through hole 22*a* and capable of sliding in the left-right direction. The slider 30 may be capable of sliding between a locked position (refer to FIG. 6) and an unlocked position (refer to FIG. 5).

The locked position is the position at which the slider 30 is engaged with the second connector 70 arranged inside the peripheral wall part 22 of the first housing 21 to regulate separation of the second connector 70 and the first connector 10 (refer to FIG. 6). In other words, when the slider 30 is located in the locked position, the end 30*a* of the slider 30 is located inside a fitting area A (refer to FIG. 6). Subsequently, the slider 30 is engaged with the second connector 70 to regulate upward movement of the second connector 70. Here, the fitting area A is the area in which the second connector 70 is arranged when the connectors 10, 70 are fitted to each other. In an example of the first connector 10, when the slider 30 is located in the locked position, the end 30*a* of the slider 30 protrudes from the inner face of the end wall part 22B to the inside the peripheral wall part 22. As will be described later, the second connector 70 has an engagement member 90. The slider 30 may be engaged with the engagement member 90.

The unlocked position is the position at which the slider 30 is separated from the second connector 70 to cancel the engagement of the slider 30 and the second connector 70 (refer to FIG. 5). In other words, when the slider 30 is located in the unlocked position, vertical movement of the second connector 70 is allowed. As illustrated in FIG. 5, when the slider 30 is located in the unlocked position, the end 30*a* of the slider 30 is retreated from the fitting area A to the outside in the left-right direction. In the example of the first connector 10, when the slider 30 is located in the locked position, the end 30*a* of the slider 30 does not protrude from the inner face of the end wall part 22B. Unlike the example of the first connector 10, when the slider 30 is located in the unlocked position, the end 30*a* of the slider 30 may protrude from the inner face of the end wall part 22B.

As illustrated in FIG. 5, the through hole 22*a* is formed in each of two end wall parts 22B facing each other, after which the slider 30 may be arranged in the through hole 22*a*. Unlike the example of the first connector 10, the through hole 22*a* is formed in only one end wall part 22B, after which the slider 30 may be arranged in this through hole 22*a*. In this case, a region engaged with the second connector 70 may be formed on other end wall part 22B.

As illustrated in FIG. 2, the slider 30 may be a plate-like member. In other words, the slider 30 may be a member with a width W1 in the front and back direction (refer to FIG. 2) that is larger than the thickness T1 (refer to FIG. 7). Further, the slider 30 may be arranged such that the thickness direction D thereof (refer to FIG. 7) is oriented in the height direction (the Z1-Z2 direction) of the first housing 21. In the example of the first connector 10, the width W1 of the slider 30 is greater than double the thickness T1. The relationship between the width W1 and the thickness T1 of the slider 30 is not limited to the example of the first connector 10. For example, the width W1 of the slider 30 may be less than double the thickness T1.

If the slider 30 is plate-like, the position of the slider 30 can be lowered, resulting in the height of the first connector 10 being capable of being lowered. Further, if the slider 30 is plate-like, it is possible to effectively prevent movement of the second connector 70 with respect to the first connector 10. Specifically, it is possible to prevent not only inclination of the second connector 70, wherein the horizontal position of one end of the second connector 70 becomes high, but also the inclination of the second connector 70, wherein the position of one end of the second connector 70 becomes high in the front and back direction. As a result, even for the case in which the contact area between the first terminal 12 of the first connector 10 and the second terminal 72 of the second connector 70 becomes small, it is possible to ensure the contact stability of the terminals 12, 72.

In the example of the first connector 10, the slider 30 is made of metal and exhibits strong rigidity. Unlike the example of the first connector 10, the slider 30 may be made of resin.

Figure 4:
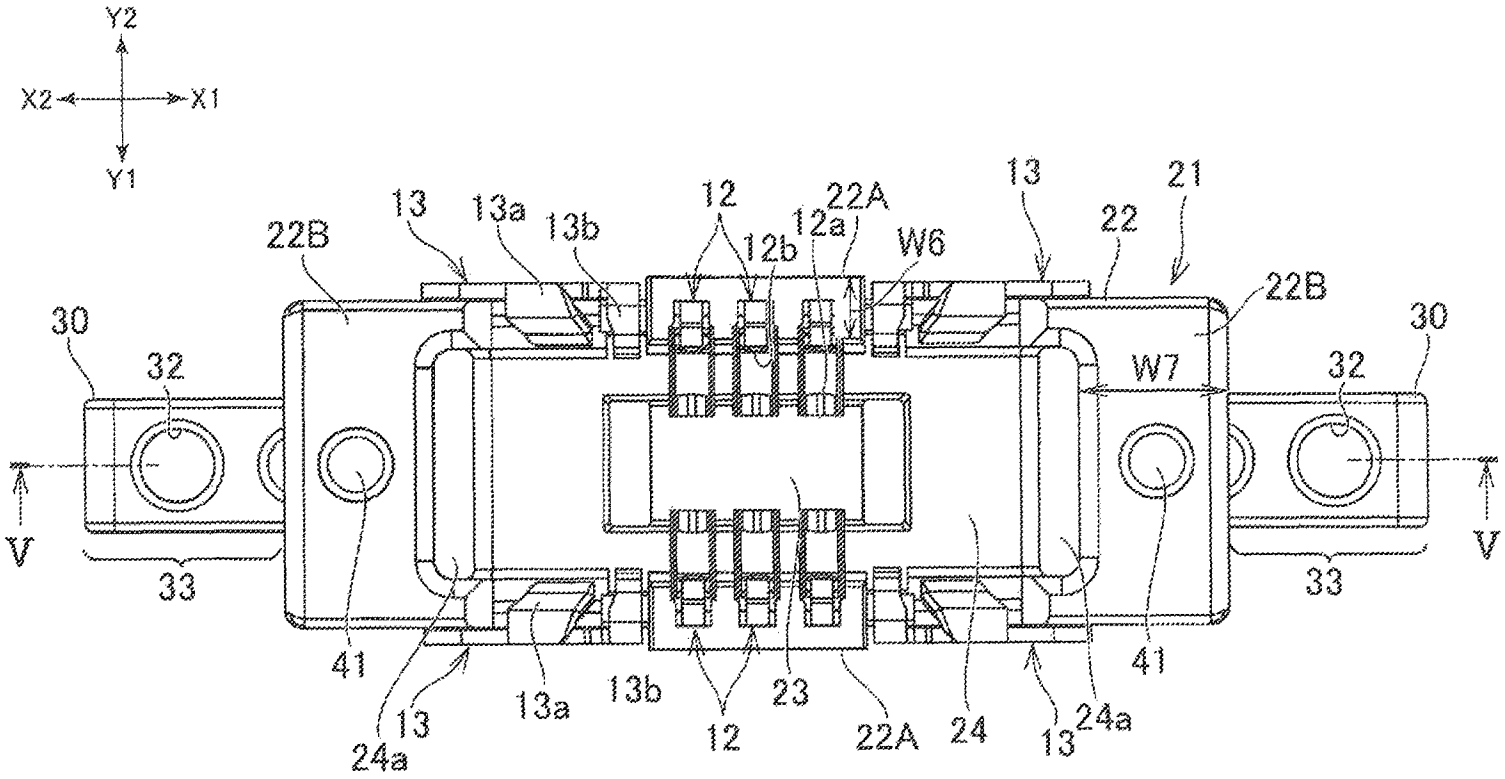
FIG. 4 is a plan view of the first connector.

The end wall part 22B may have a width W7 that is relatively large in the left-right direction (refer to FIG. 4). In the example of the first connector 10, the width W7 of the end wall part 22B in the left-right direction is larger than the width W6 in the front and back direction of wall part 22A (refer to FIG. 4). Thereby, it is possible to effectively prevent the slider 30 from being inclined. The relation between the width W7 of the end wall part 22B and the width W6 of the wall part 22A is not limited to the example of the first connector 10.

As described above, a plurality of first terminals 12 is attached to the wall part 22A of the first housing 21. In the example of the first connector 10, the plurality of first terminals 12 is attached to a center part in the left-right direction of the wall part 22A. As illustrated in FIG. 2, the height of the wall part 22A in the area where the first terminal 12 is attached may be lower than that of the end wall part 22B. Thereby, when the first connector 10 and the second connector 70 are fitted to each other, it is possible to lower the position of the second connector 70. As a result, it is possible to reduce the distance between the circuit boards E1, E2. In the examples of connectors 10, 70, when they are fitted to each other, the second connector 70 is located entirely between the facing two end wall parts 22B (refer to FIG. 6).

As illustrated in FIG. 7, the slider 30 has a portion 33 that protrudes from the through hole 22*a* formed in the first housing 21 to the outside in the left-right direction (hereinafter, this portion 33 is referred to as the "operation part"). An operator can push or pull the operation part 33. The operation part 33 may be folded toward the lower face of the first connector 10. In other words, the operation part 33 has a first portion 33*a* extending from the through hole 22*a* to the outside in the left-right direction, along with a second portion 33*b* folded to the first portion 33*a* which is located below the first portion 33*a*. According to this structure, when a force acts to push the operation part 33 downward, the second portion 33*b* and the circuit board E1 below it (refer to FIG. 1) can support the operation part 33, making it possible to prevent deformation of the operation part 33.

In the example of the first connector 10, the lower face 33*c* of the second portion 33*b* is located substantially at the same height as that of the lower face 22*d* of the end wall part 22B. Unlike the example of the first connector 10, the position of the lower face 33*c* of the second portion 33*b* may be higher than that of the lower face 22*d* of the end wall part 22B. In another further example, the operation part 33 of the slider 30 may be designed to not have the second portion 33*b*.

Figure 8:
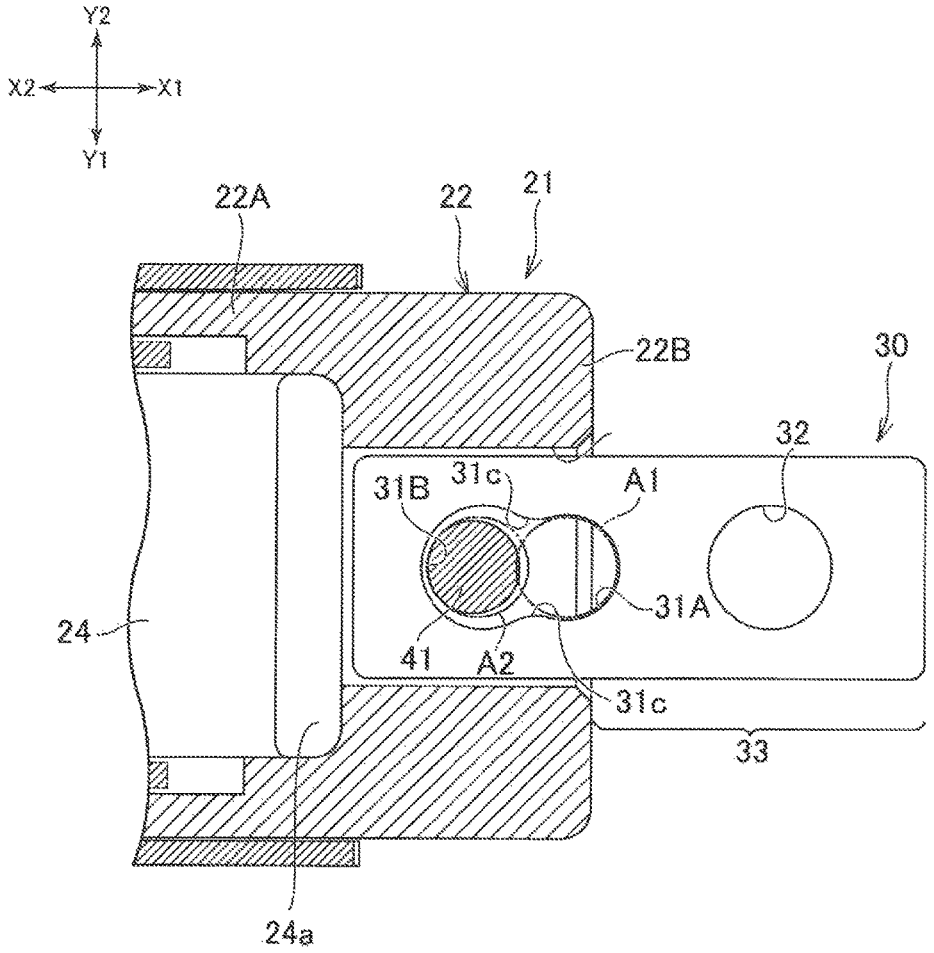
FIG. 8 is a cross-sectional view of the first connector taken along line VIII-VIII of FIG. 5. In this drawing, a slider having the first connector is disposed in an unlocked position.

An engagement part capable of hooking a tool thereon may be formed on the operation part 33 of the slider 30. The engagement part is, for example, a hole, a recessed portion, a convex part, a bump, etc. The operator can move the slider 30 by hooking the tool on the engagement part of the slider 30. In the example of the first connector 10, as illustrated in FIG. 7 and FIG. 8, an engagement hole 32 is formed in the operation part 33. The operator can move the slider 30 by hooking the tool on the edge of the engagement hole 32. The tool is, for example, a rod shaped tool such as a pincette or a screwdriver. Instead of a pincette, etc., a dedicated tool may be used. The engagement hole 32 is, for example, a hole penetrating the slider 30. In the example of the first connector 10, the engagement hole 32 is formed in the first portion 33*a* of the operation part 33. The second portion 33*b* is positioned below the engagement hole 32.

Unlike the example of the first connector 10, the engagement hole 32 may be designed so as to not penetrate the slider 30. In other words, the engagement hole 32 may be a recessed portion formed on the top of the slider 30. In another further example, a convex part protruding upward may be formed on the operation part 33 as the engagement part. In another further example, a convex part and a recessed portion may be formed at the edge of the operation part 33 of the slider 30 as the engagement part.

As illustrated in FIG. 5 and FIG. 6, in the example of the first connector 10, both when the slider 30 is positioned in the locked position and when the slider 30 is positioned in the unlocked position, the engagement hole 32 is positioned outside the through hole 22*a* formed in the end wall part 22B. Unlike the example of the first connector 10, when the slide 30 is positioned in the locked position, part of the engagement hole 32 may be positioned inside the through hole 22*a*.

As illustrated in FIG. 7, the first connector 10 may have a retaining member 41 vertically inserted into the end wall part 22B and the slider 30 of the first housing 21. The retaining member 41 can prevent the slider 30 from slipping from the end wall part 22B. In the example of the first connector 10, a hole 22*b* vertically penetrating the end wall part 22B is formed on the end wall part 22B. A hole 31 vertically penetrating the slider 30 is formed in the slider 30. The retaining member 41 is, for example, a pin type that extends vertically. In greater detail, the retaining member 41 is, for example, a columnar type that extends vertically. The retaining member 41 is inserted into the holes 22*b*, 31. In the example of the first connector 10, the hole 22*b* of the end wall part 22B is positioned at the center of the end wall part 22B in the front and back direction. The hole 31 of the slider 30 is positioned at the center of the slider 30 in the front and back direction.

Figure 9:
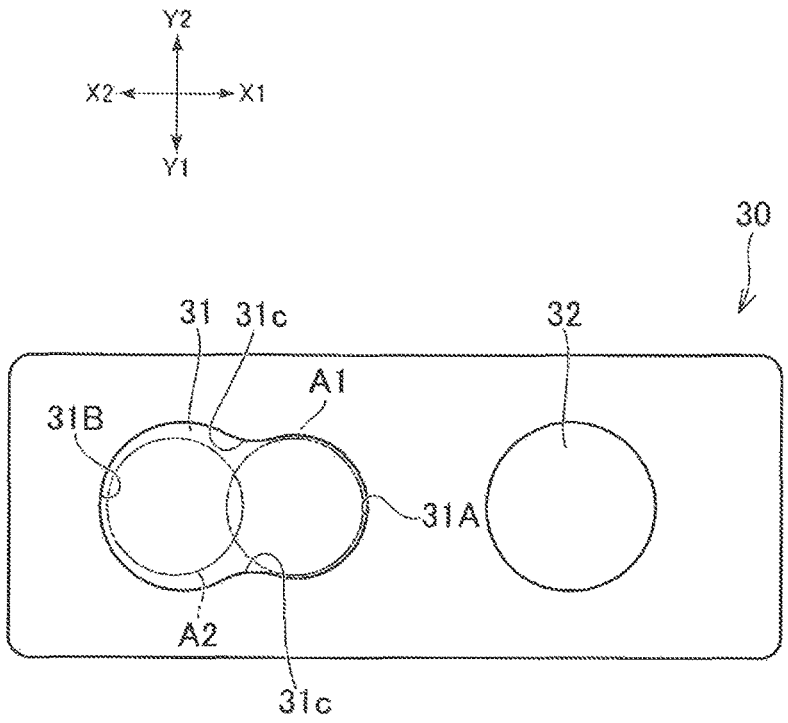
FIG. 9 is a plan view of a slider included in the first connector.

The size of the hole 22*b* of the end wall part 22B corresponds to the thickness (the diameter) of the retaining member 41. On the other hand, as illustrated in FIG. 8, the size of the hole 31 of the slider 30 is larger than the thickness of the retaining member 41 in the left-right direction. Thereby, movement of the slider 30 in the left right direction is allowed. In the example of the first connector 10, as illustrated in FIG. 9, the hole 31 of the slider 30 has a first area A1 and a second area A2 therein. The first area A1 is the area in which the retaining member 41 is arranged when the slider 30 is positioned in the locked position. The second area A2 is the area in which the retaining member 41 is arranged when the slider 30 is positioned in the unlocked position.

The inner edge of the hole 31 of the slider 30 may have a portion that generates resistance against the movement of the slider 30 in contact with the retaining member 41 when the slider 30 moves between the locked position and the unlocked position. Thus, it is possible to prevent the slider 30 from moving between the locked position and the unlocked position, for example, against the will of the operator or user. As illustrated in FIG. 9, in the example of the first connector 10, the inner edge of the hole 31 has an inner edge 31A formed in an arc shape defining the first area A1, an inner edge 31B formed in an arc shape defining the second area A2, and a mid part 31*c* positioned at the boundary between the inner edge 31A and the inner edge 31B. In the example of the first connector 10, the inner edge of the hole 31 has two mid parts 31*c* facing each other in the front and back direction. The two mid parts 31*c* expand toward the inside of the hole 31. During the process in which the slider 30 moves between the locked position and the unlocked position, the mid part 31*c* of the hole 31 is in contact with the outer face of the retaining member 41 to generate resistance against movement of the slider 30.

When the operator moves the slider 30 from the unlocked position to the locked position, the operator needs to move the slider 30 with a force that is larger than the resistance acting on the slider 30 from the mid part 31*c*. After the slider 30 passes over the mid part 31*c*, the slider 30 reaches the locked position by inertial force. In other words, the mid part 31*c* is able to prevent the slider 30 from stopping at the position between the locked position and the unlocked position. The shape of the hole 31 is not limited to the example of the first connector 10. For example, the inner edge of the hole 31 may be designed to not have a portion where resistance against movement of the slider 30 is generated.

As illustrated in FIG. 7, when the slider 30 is positioned in the locked position, the retaining member 41 may contact the slider 30. In the example of the first connector 10, when the slider 30 is positioned in the locked position, the retaining member 41 may contact the end 31*a* of the inner edge of the hole 31 of the slider 30 (here, "the end 31*a* of the inner edge" is the end of the horizontal outside). When the slider 30 is positioned in the locked position, the movement of the slider 30 toward the horizontal center is regulated by the retaining member 41.

As illustrated in FIG. 7, when the slider 30 is positioned in the locked position, a clearance G1 may be horizontally ensured between the end 30*a* of the slider 30 and the second connector 70. According to this structure, when the slider 30 is slid from the unlocked position to the locked position, it is possible to prevent the slider 30 from crashing with the second connector 70. As will be described later, in the example of the second connector 70, a recessed portion 82*a* for securing the clearance G1 is formed in the second housing 81.

As described above, the retaining member 41 is inserted into the hole 22*b* formed in the end wall part 22B of the first housing 21. The first housing 21 is made of resin. On the other hand, the retaining member 41 is made of, for example, a metal. Thereby, it is possible to reinforce the end wall part 22B via the retaining member 41. For example, it is considered that the force to move the second connector 70 upward acts with the slider 30 engaged with the second connector 70. In this case, when the end 30*a* of the slider 30 is lifted by the second connector 70, the slider 30 may crash with the edge of the through hole 22*a* of the end wall part 22B. The retaining member 41 can increase the strength of the end wall part 22B against such a colliding force. As described above, the hole 22*b* of the end wall part 22B corresponds with the thickness (diameter) of the retaining member 41. As a result, the outer face of the retaining member 41 adheres to the inner face of the hole 22*b* of the end wall part 22B. During the production process of the first connector 10, the retaining member 41 may be press fit into the hole 22*b*.

As described above, the hole 22*b* formed in the end wall part 22B vertically penetrates the end wall part 22B. As illustrated in FIG. 7, the lower end 41*a* of the retaining member 41 may be exposed on the lower face 22*d* of the end wall part 22B of the first housing 21. When using the first connector 10, the lower end 41*a* of the retaining member 41 may be soldered onto the circuit board E1. In this manner, it is possible to increase the attachment strength of the first connector 10 to the circuit board E1. In the example of the first connector 10, the lower face 22*d* of the end wall part 22B may have a recessed portion 22*c* surrounding the lower end 41*a* of the retaining member 41. In other words, the diameter of the lower end of the hole 22*b* into which the retaining member 41 is inserted may be larger than the diameter of the other portion of the hole 22*b*. According to this structure, a space surrounding the lower end 41*a* is formed around the lower end 41*a* of the retaining member 41. In the case of soldering the lower end 41*a* of the retaining member 41 onto the circuit board E1, it is possible to accommodate solder in this space (the recessed portion 22*c*).

The structure to attach the retaining member 41 to the end wall part 22B is not limited to the example of the first connector 10. For example, the design may be such that the hole 22*b* does not penetrate the end wall part 22B. In other words, the hole 22*b* may have a bottom face.

The structure to prevent slipping of the slider 30 is not limited to the example of the first connector 10. For example, the slider 30 may have a notch formed on the edge of the slider 30 instead of the hole 31. The end wall part 22B may have a hole at the position corresponding to this notch. The retaining member 41 may prevent slipping of the slider 30 by being engaged with the notch of the slider 30.

As illustrated in FIG. 3, the second connector 70 may have an engagement member 90 made of metal and attached to the second housing 81. The slider 30 may regulate the upward movement of the second connector 70 by being engaged with the engagement member 90 when positioned in the locked position. According to this structure, it is possible to increase the strength of the second connector 70. As a result, when a force acts to move the second connector 70 upward with the slider 30 engaged with the second connector 70, it is possible to prevent the second connector 70 from being damaged.

As illustrated in FIG. 3, the engagement member 90 may have a portion 91 to cover the end face of the second housing 81 (hereinafter, this portion 91 is referred to as the "end face part"). The engagement hole 91*a* may be formed in this end face part 91. In the example of the second connector 70, the engagement hole 91*a* penetrates the end face part 91. Instead of the example of the second connector 70, the engagement hole 91*a* may be a hole not penetrating the end face part 91 (a recessed portion). As illustrated in FIG. 7, when the slider 30 is positioned in the locked position, the end 30*a* of the slider 30 is fitted into the engagement hole 91*a*. In other words, the slider 30 is engaged with the engagement member 90.

As described above, in the example of the first connector 10, the slider 30 is a plate-like member. Therefore, as illustrated in FIG. 3, the engagement hole 91*a* of the engagement member 90 is a hole elongated in the front and back direction. The width W3 in the front and back direction of the engagement hole 91*a* is larger than the vertical width W4 thereof. The end face part 91 has the portion 91*b* positioned on the front side of the engagement hole 91*a* to configure the edge of the engagement hole 91*a*, and the portion 91*c* positioned on the back side of the engagement hole 91*a* to configure the edge of the engagement hole 91*a*. The width W3 in the front and back direction of the engagement hole 91*a* may be larger than the sum of the widths W5 of these two portions 91*b*, 91*c*.

As illustrated in FIG. 7, the lower edge 91*d* of the end face part 91 may be positioned below the lower face 82*b* of the end wall part 82B of the second housing 81. Moreover, the bottom face 24 of the first housing 21 may have a hole 24*a* positioned at a position corresponding to the lower edge 91*d* of the end face part 91 of the engagement member 90. With the first connector 10 and the second connector 70 fitted together, the lower edge 91*d* of the end face part 91 of the engagement member 90 may be positioned inside the hole 24*a* of the bottom face 24. In other words, the position of the lower edge 91*d* of the end face part 91 may be lower than the upper face 24*b* of the bottom face 24. In this way, it is possible to lower the position of the engagement hole 91*a*. As a result, with the first connector 10 and the second connector 70 fitted together, it is possible to decrease the heights thereof. In the example of the first connector 10, the hole 24*a* vertically penetrates the bottom face 24. Unlike the example of the first connector 10, the design may be such that the hole 24*a* does not penetrate the bottom face 24. In another further example, the bottom face 24 may not have a hole 24*a*.

As described above, the engagement member 90 is attached to the second housing 81. In the example of the second connector 70, as illustrated in FIG. 7, the engagement member 90 has an upper face part 92 connected to the upper edge of the end face part 91, and an attaching part 93 folded with respect to the upper face part 92, and inserted into a hole formed in the second housing 81. The attaching structure of the engagement member 90 with respect to the second housing 81 may be appropriately changed without being limited to the example of the second connector 70.

As described above, the slider 30 is formed by a plate. In the example of the connector assembly 1, the engagement member 90 is also formed by a plate. In this manner, if both the slider 30 and the engagement member 90 are made of metal, when a force acts to move the second connector 70 upward with the slider 30 engaged with the second connector 70, it is possible to effectively prevent the second connector 70 and the first connector 10 from being damaged. As illustrated in FIG. 7, in the example of the connector assembly 1, the thickness T1 of the slider 30 is larger than the thickness T2 of the engagement member 90. Unlike the example of the connector assembly 1, the thickness T1 of the slider 30 may be the same as the thickness T2 of the engagement member 90, or may be less than the thickness T2 of the engagement member 90.

As described above, in the example of the connector assembly 1, when the slider 30 is positioned in the locked position, the horizontal clearance G1 is ensured between the end 30*a* and the second connector 70 of the slider 30 (refer to FIG. 7). In the example of the second connector 70, the end face of the second housing 81 has a gap between itself and the end face part 91 of the engagement member 90. In greater detail, the second housing 81 has, at the end of the second housing 81 (the end face of the end wall part 82B) in the left-right direction, a recessed portion 82*a* opened to the outside in the left-right direction and opened downward. When the slider 30 is positioned in the locked position, the clearance G1 in the left-right direction is ensured between the end 30*a* of the slider 30 and the inner face of the recessed portion 82*a*. The structure of the second connector 70 may be appropriately changed. For example, the second housing 81 is not necessarily required to have a recessed portion 82*a*.

As described above, in the example of the first connector 10, the through hole 22*a* is formed in the end wall part 22B of the first housing 21, with the slider 30 arranged in this through hole 22*a*. The slider 30 can be slid in the left-right direction between the locked position (refer to FIG. 6) at which the slider 30 is engaged with the second connector 70, and the unlocked position at which the slider 30 is separated from the second connector 70. The slider 30 is a plate-like member arranged such that the thickness direction D thereof (refer to FIG. 7) is oriented in the height direction (the Z1-Z2 direction) of the first housing 21. Thereby, it is possible to effectively prevent movement of the second connector 70 with respect to the first connector 10. As a result, even for the case in which the contact area between the first terminal 12 of the first connector 10 and the second terminal 72 of the second connector 70 becomes small, it is possible to ensure the contact stability of the terminals 12, 72.

The connector and the connector assembly proposed in the present disclosure are not limited to the examples of the connectors 10, 70. It is obvious to persons skilled in the art that there are other embodiments capable of obtaining the same functions and results. Such other embodiments that are substantially the same are covered by the claims.

For example, the second connector 70 may be designed not having an engagement member 90. In this case, the end 30*a* of the slider 30 may be engaged with the second housing 81. In other words, a region in which the slider 30 is engaged with the second housing 81 (for example, a recessed portion) may be formed.

The invention claimed is:

1. A connector assembly, comprising:

a first connector having: a first housing; and a plurality of first terminals attached to the first housing and aligned in a first direction; and a second connector having a second housing and a plurality of second terminals aligned in the first direction;

wherein the first housing has a peripheral wall part having at an inner side a recessed portion at which the second connector is arranged, the peripheral wall part has: two wall parts extending in the first direction, and opposing each other in a second direction orthogonal with respect to the first direction; and end wall parts positioned at the ends of the two wall parts, and extending in the second direction, a through hole penetrating each of the end wall parts in the first direction is formed in each of the end wall parts, the first connector has a slider arranged in the through hole, the slider can be slid in the first direction between a locked position at which the slider is engaged with the second connector and an unlocked position at which the slider is separated from the second connector when the second connector is arranged inside the peripheral wall part, and the slider is a plate-like member arranged such that the thickness direction thereof is oriented to a third direction which is the height direction of the first housing, wherein the connector assembly further comprises a retaining member inserted in the third direction into the end wall part and the slider.

2. The connector assembly according to claim 1, wherein a hole into which the retaining member is inserted is formed between the end wall part and the slider.

3. The connector assembly according to claim 1, wherein, when the slider is positioned in the locked position, the retaining member contacts the slider to regulate movement of the slider toward the center of the first connector in the first direction, and a clearance in the first direction is provided between the end of the slider and the second connector.

4. The connector assembly according to claim 1, wherein the slider has a portion that generates resistance against the movement of the slider in contact with the retaining member when the slider moves between the locked position and the unlocked position.

5. The connector assembly according to claim 4, wherein a hole into which the retaining member is inserted is formed in the slider, and the portion that generates resistance against the movement of the slider is formed at the inner edge of the hole.

6. The connector assembly according to claim 1, wherein the second connector has an engagement member attached to the second housing and formed by metal, and the slider is engaged with the engagement member to regulate movement of the second connector in the third direction when the slider is positioned in the locked position.

7. The connector assembly according to claim 6, wherein a hole into which the end of the slider is fitted when the slider is positioned in the locked position is formed in the engagement member.

8. The connector assembly according to claim 1, wherein the slider has a portion that protrudes from the through hole to the outside in the first direction, and an engagement part capable of hooking a tool thereon is formed on the portion of the slider.

9. The connector assembly according to claim 1, wherein the slider has a portion that protrudes from the through hole to the outside in the first direction, and the portion of the slider is folded toward the bottom face of the first connector.

10. The connector assembly according to claim 1, wherein the wall part of the first housing has an area at which the plurality of first terminals is attached, and the height of the wall part of the first housing in the area is lower than the height of the end wall part.

11. A connector, comprising:

a housing; and a plurality of terminals attached to the housing and aligned in a first direction;

wherein the housing has a peripheral wall part having at an inner side a recessed portion at which another connector is arranged, the peripheral wall part has: two wall parts extending in the first direction and opposing each other in a second direction orthogonal with respect to the first direction; and end wall parts positioned at the ends of the two wall parts and extending in the second direction, a through hole penetrating each of the end wall parts in the first direction is formed in each of the end wall parts, a slider is arranged in the through hole, the slider can be slid in the first direction between a locked position at which the slider is engaged with the other connector and an unlocked position at which the slider is separated from the other connector when the other connector is arranged inside the peripheral wall part, and, the slider is a plate-like member arranged such that the thickness direction thereof is oriented to a third direction which is the height direction of the housing, wherein the connector further comprises a retaining member inserted in the third direction into the end wall part and the slider.

* * * * *